United States Patent [19]

Olsson

[11] 4,398,069

[45] Aug. 9, 1983

[54] SEALED ELECTRICAL CONTACT ASSEMBLY AND ACTUATING MECHANISM THEREFOR

[75] Inventor: Billy E. Olsson, New Cumberland, Pa.

[73] Assignee: AMP Incorporated, Harrisburg, Pa.

[21] Appl. No.: 371,838

[22] Filed: Apr. 26, 1982

[51] Int. Cl.[3] ..... H01H 19/00; H01H 21/00

[52] U.S. Cl. ..... 200/6 R; 200/6 B; 200/302; 200/339; 200/68

[58] Field of Search ..... 200/6 A, 6 R, 6 B, 6 BA, 200/6 BB, 6 C, 67 D, 67 G, 67 R, 68, 302, 339; 74/97

[56] References Cited

U.S. PATENT DOCUMENTS

| | | | |
|---|---|---|---|
| 2,623,142 | 12/1952 | Karl | 200/67 R |
| 2,951,130 | 8/1960 | Mason | 200/67 G |
| 3,167,622 | 1/1965 | Locher | 200/68 |
| 3,403,236 | 9/1968 | Zoludow | 200/67 G |
| 3,902,032 | 8/1975 | Koepke | 200/159 A X |
| 4,018,999 | 4/1977 | Robinson et al. | 200/306 X |
| 4,302,637 | 11/1981 | Ditzig | 200/6 R |
| 4,311,884 | 1/1982 | Henley et al. | 200/5 R |

FOREIGN PATENT DOCUMENTS

| | | | |
|---|---|---|---|
| 1434254 | 2/1966 | France | 200/68 |
| 801206 | 9/1958 | United Kingdom | 200/67 R |

*Primary Examiner*—Stephen Marcus
*Assistant Examiner*—Ernest G. Cusick
*Attorney, Agent, or Firm*—Adrian J. LaRue

[57] ABSTRACT

An actuating mechanism comprises a housing having top and sides with openings in the sides that extend into the top. A bottom member is latchably secured to the housing. A rocker member is mounted in the housing and is rockably moved about pie-shaped pivots. A leaf spring is disposed in a slot in the rocker member and extends across a central bore therein. A button is movably located in the central bore and is spring biased into engagement with the bottom member via the leaf spring which also biases the rocker member against an inside top surface of the housing. Actuating arms extend outwardly from the rocker member and through the openings for actuating the rocker member. Stop surfaces of the rocker member engage the inside top surface of the housing to limit movement of the rocker member.

20 Claims, 17 Drawing Figures

SEALED ELECTRICAL CONTACT ASSEMBLY AND ACTUATING MECHANISM THEREFOR

FIELD OF THE INVENTION

This invention relates to an electrical switch assembly and more particularly to a sealed electrical contact assembly and electrical switch made therefrom for use on a printed circuit board.

BACKGROUND OF THE INVENTION

Dual in line package (DIP) switches have been used for many years. They are mounted on a printed circuit board and subjected to flow soldering to solder their pins to appropriate circuit paths on the printed circuit board. Thereafter, the soldered printed circuit board is cleaned to remove flux therefrom.

The DIP switches in undergoing the flow soldering and cleaning operations can become contaminated thereby resulting in switch failures requiring them to be replaced which is time-consuming and costly.

U.S. patent application Ser. No. 326,723 filed Dec. 2, 1981, the disclosure of which is completely incorporated herein by reference, discloses a sealed electrical contact assembly and an actuating mechanism for operating a movable electrical contact member of the sealed electrical contact assembly.

In assembling the parts together to form the actuating mechanism, problems have been encountered due to the configurations of the parts and the tolerances thereof. This is especially true when automatic assembly machinery is involved.

SUMMARY OF THE INVENTION

According to the present invention, a sealed electrical contact assembly comprises a dielectric frame in which a plurality of aligned stationary electrical contact members are secured as opposing sets of contact members and movable electrical contact members interconnect each set of stationary contact members. One of the opposing sets of stationary contact members and the movable contact members have mateable pivot areas at which the movable contact members are mounted so that the movable contact members can be moved to a position electrically connecting the opposing sets of stationary contact members. A membrane is sealingly secured onto the frame covering each set of stationary and movable contact members associated therewith. A housing is latchably secured onto the contact-carrying frame and includes rocker members disposed therein thereby forming an electrical switch. Each of the rocker members has a spring-biased member engaging a movable contact member through the membrane. Sections of the rocker members are engageable to move the rocker members from one position moving the movable contact members via the spring-biased members to a position electrically connecting the opposing sets of stationary contact members and to another position moving the movable contact members to a position disconnecting the opposing sets of stationary contact members.

According to another aspect of the present invention, an actuating mechanism comprises a housing having top and sides with openings in the sides that extend into the top. A bottom member is latchably secured to the housing. A rocker member is mounted in the housing and is rockably moved about pie-shaped pivots. A leaf spring is disposed in a slot in the rocker member and extends across a central bore therein. A button is movably located in the central bore and is spring biased into engagement with the bottom member via the leaf spring which also biases the rocker member against an inside top surface of the housing. Actuating arms extend outwardly from the rocker member and through the openings for actuating the rocker member. Stop surfaces of the rocker member engage the inside top surface of the housing to limit movement of the rocker member.

DETAILED DESCRIPTION OF THE PREFERRED EMBODIMENT

Figure 1:
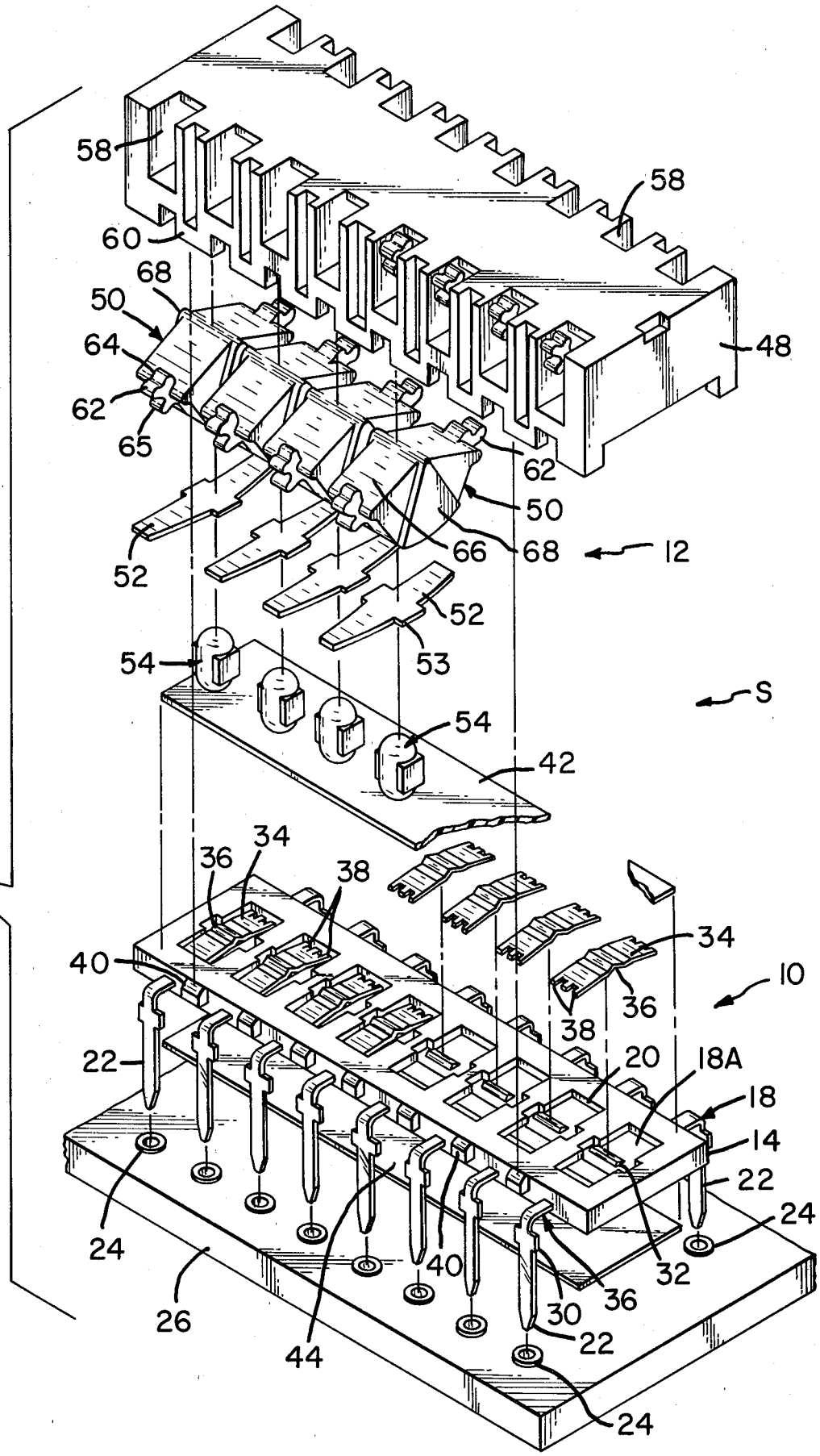
FIG. 1 is an exploded perspective view showing the various parts of the switch of the present invention.
Figure 2:
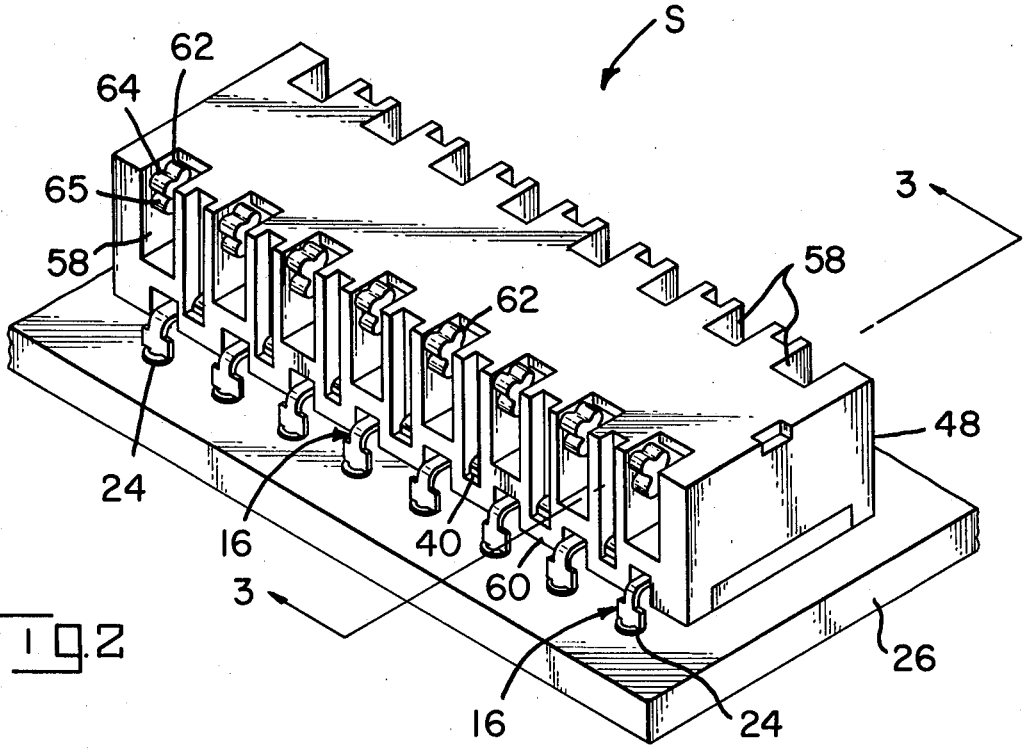
FIG. 2 is a view similar to FIG. 1 of an assembled switch.
Figure 3:
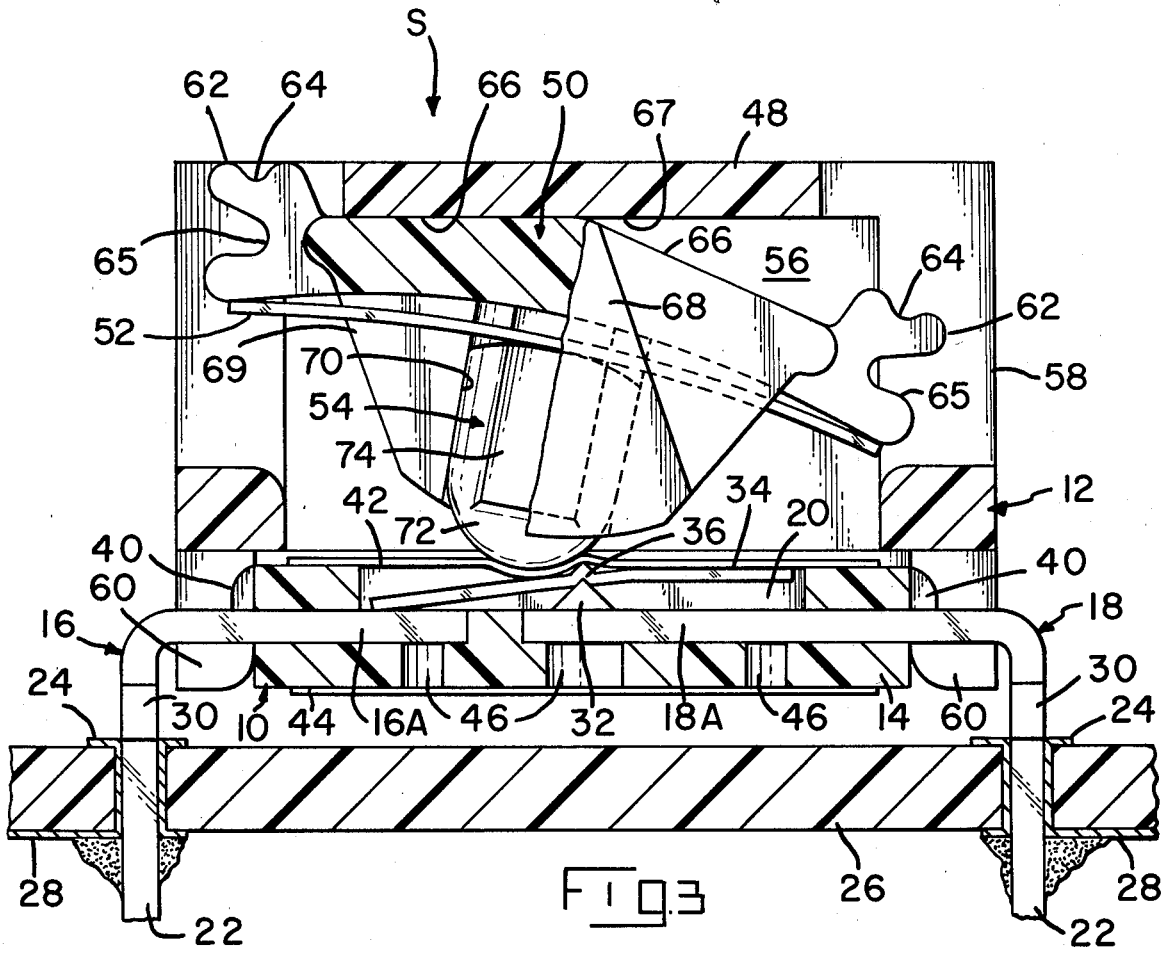
FIG. 3 is a cross-sectional view taken along line 3—3 of FIG. 2 with parts broken away.

FIGS. 1–3 illustrate the sealed electrical contact assembly 10 and the contact-actuating mechanism 12 that is latchably secured thereto thereby forming DIP switch S as illustrated in FIGS. 2 and 3. Dielectric frame 14 is molded from a suitable commercially-available plastic material and it has a series of aligned electrical contact members 16, 18 molded in place therein. Electrical contact members 16, 18 are arranged in dielectric frame 14 having opposed stationary electrical contact sections 16A, 18A which are exposed in recesses 20 in the top surface of frame 14. Each of electrical contact members 16, 18 has an electrical terminal section 22 extending outwardly from frame 14 for electrical connection with plated through holes 24 disposed in proper alignment in printed circuit board 26 with holes 24 electrically connected to appropriate circuit paths 28 located thereon. Plated through holes 24 can be sockets if desired. Electrical terminal sections 22 are provided with projections 30 to limit the movement of electrical terminal sections 22 within holes 24 in order to space switch S from board 26 to facilitate cleaning after soldering operation. Electrical contact sections 18A are provided with upwardly-directed pivot members 32 that have been stamped therefrom.

Moveable electrical contact members 34 have V-shaped embossments 36 formed therein which mate with pivot members 32 and the ends are provided with contact fingers 38 to provide contact redundancy when movable contact members 34 are moved into electrical contact with stationary contact sections 16A as illustrated in FIG. 3. V-shaped embossments 36 in engagement with pivot members 32 positively position movable contact members 34 relative to the respective sets of stationary contact sections 16A, 18A within recesses 20. Latching lugs 40 having beveled surfaces extend outwardly from the sides of frame 14 between terminal sections 22.

Membranes 42, 44 of a commercially-available plastic material are sealingly secured on the top and bottom surfaces of frame 14 by a commercially-available adhesive material. Membrane 42 covers all of recesses 20 with movable contact members 34 pivotally mounted via V-shaped embossments 36 on pivot members 32 of electrical contact members 18 and membrane 44 covers holes 46 in frame 14. As can be discerned, membrane 42 not only maintains movable contact members 34 in position in recesses 20 and on pivot members 32 of stationary contact members 18, but membranes 42, 44 also seal electrical contact assemply 10 from contaminants, especially during the flow soldering and cleaning operations the contact assembly will be subjected and during their operating life. While membrane 44 is disclosed as covering the bottom surface of frame 14 to cover holes 46 therein, frame 14 can be molded without holes 46 therein thereby eliminating membrane 44 and using only membrane 42 adhered to the top surface of frame 14, if desired.

Contact-actuating mechanism 12 includes housing 48, rocker members 50, leaf springs 52 and buttons 54. Housing 48, rocker members 50 and buttons 54 are molded from a commercially-available plastic material. Leaf springs 52 are stamped and formed from a suitable metal having the necessary spring characteristics.

Housing 48 has separate cavities 56 which receive therein contact-operating members comprising rocker members 50, leaf springs 52 and buttons 54 therein as illustrated in FIG. 3. Rectangular openings 58 are located in housing 48 which communicate respectively with cavities 56. Latches 60 extend outwardly from the bottom surface of housing 48 to mate with latching lugs 40 on frame 14 to latchably secure housing member 48 onto frame 14 with the contact-operating members in position in cavities 56 thereby forming switch S as illustrated in FIGS. 2 and 3.

Rocker members 50 have actuating members 62 which extend through rectangular openings 58 and they have V-shaped notches 64, 65 therein which are engaged by a probe to move rocker members 50 from a contact-actuated position as illustrated in FIG. 3 to a non-contact-actuated position opposite to that illustrated in FIG. 3. Actuating members 62 are profiled so as not to extend above the top surface of housing 48 in either one of its operated positions. Notches 64 enable operation of rocker member 50 from above whereas notches 65 enable operation of rocker members 50 from the sides in a manner similar to that disclosed in U.S. patent application Ser. No. 327,666 filed Dec. 7, 1981, the disclosure of which is completely incorporated herein by reference. Inclined surfaces 66 of rocker members 50 engage the inside top inside surface 67 of housing 48 to limit movement of rocker members 50 within cavities 56. Pie-shaped members 68 extend outwardly from each side of rocker members 50 and the apexes thereof along with the apex of inclined surfaces 66 define a pivot to enable rocker members 50 to operate thereabout in a reciprocal manner within cavities 56 to operate contact assembly 10. The apexes of members 68 and surfaces 66 engage the upper inside surface of housing 48 to define a pivot point therefor and the bottom arcuate surfaces of members 68 rock along the membrane-covered top surface of frame 14 when rocker members 50 are moved from one position to another.

Figure 4:
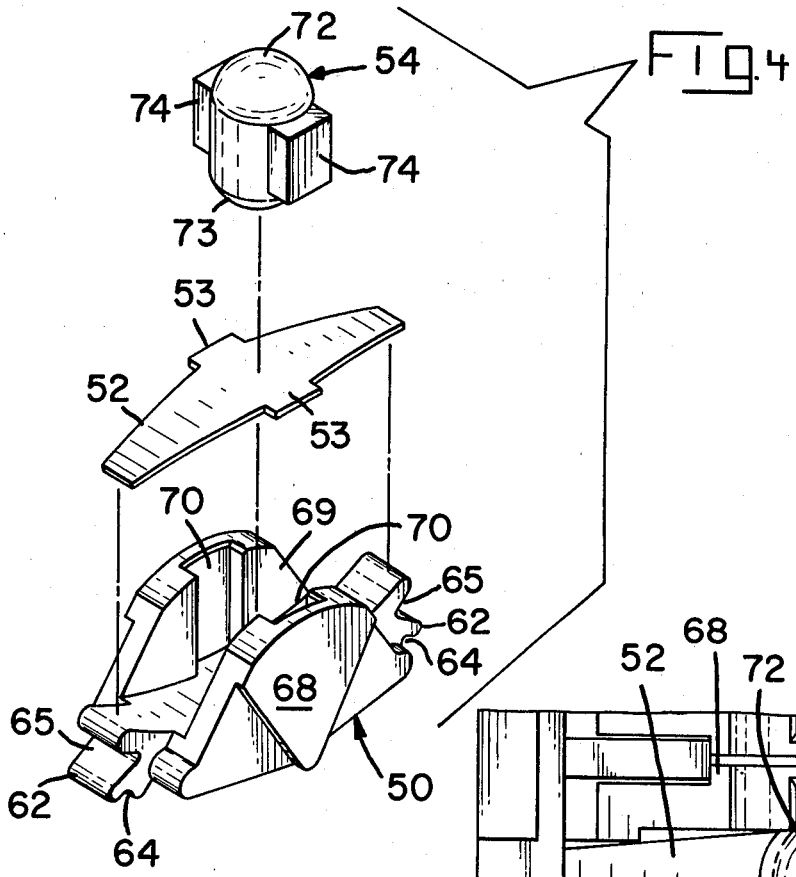
FIG. 4 is an exploded perspective view of the rocker member, leaf spring and button.
Figure 5:
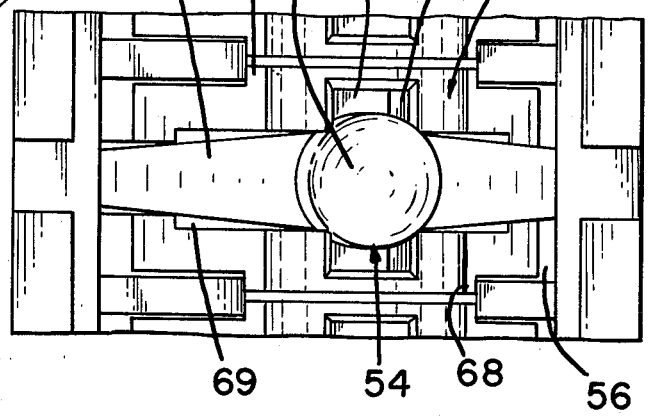
FIG. 5 is a top plan view of the elements of FIG. 4 assembled together and in position in a cavity of the housing.

Rocker members 50 as shown in FIGS. 4 and 5 have slots 69 and recesses 70 therein in which leaf springs 52 and buttons 54 are disposed. Buttons 54 have rounded ends 72, 73 and projections 74 that are disposed in recesses 70 to guide movement of buttons 54 in rocker members 50 and to operate movable contact members 34 as illustrated in FIG. 3 through membrane 42. Leaf springs 52 are arcuate shaped and have projections 53 extending outwardly therefrom which are disposed in recesses 70 when the leaf springs are positioned in slots 69. The ends of leaf springs 52 extend along actuating members 62. Buttons 54 engage leaf springs 52 thereby exerting pressure on buttons 54 causing rounded ends 72 to springably engage movable contact members 34 through membrane 42 and to urge rocker members 50 against the upper inside surface 67 of housing 48.

Figure 6:
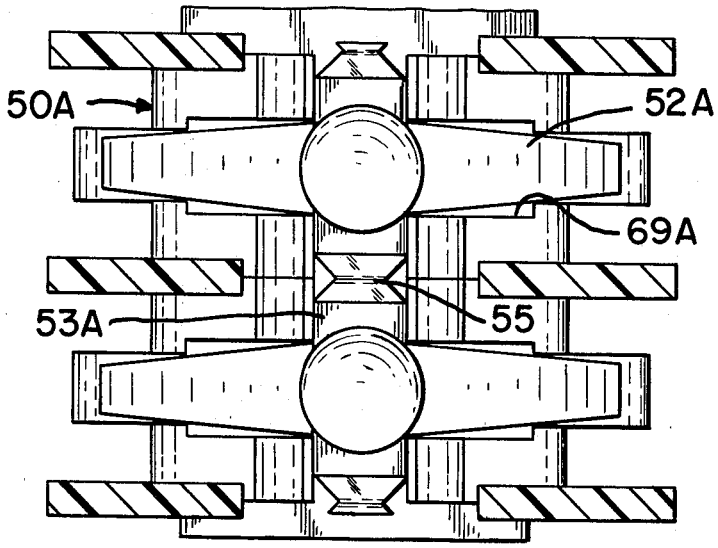
FIG. 6 is a view similar to that of FIG. 5 showing another embodiment of the invention.

FIG. 6 illustrates an alternative embodiment of the invention whereby leaf springs 52A are interconnected at necked-down sections 55 between projections 53A of adjacent leaf springs. In this way, leaf springs 52A are interconnected and they are readily positioned within slots 69A of rocker members 50A. The necked-down sections 55 do not effect the operation of rocker members 50A and, after a number of actuations of the rocker members, the necked-down sections are susceptible to breaking which will not affect the operations of the rocker members.

Actuating mechanism 12 can be used to move a movable member 34 via rocker member 50 from one position to another upon forces being applied to actuating members 62 with spring-biased button 54 being maintained in one or the other positions by engagement with either side of embossment 36 to maintain movable member 34 at such position and inclined surfaces 66 limit movement of the rocker member.

In operation with reference to FIG. 3, a probe (not shown) is inserted into the left-side notches 64 or 65 for applying a force to rocker member 50. This causes the bottom arcuate surfaces of members 68 to engage the top surface of frame 14 through membrane 42 thereby causing rocker member 50 to rock about such arcuate surfaces with button 54 being depressed inwardly against the action of leaf spring 52 as it rides along V-shaped embossment 36. So long as the force applied to rocker member 50 does not enable button 54 to extend slightly beyond the center thereof, rocker member 50 will move back to its original position. If the operating force exerted by the probe is sufficient to move button 54 via rocker member 50 beyond the center of button 54, the configuration of embossment 36 on pivot member 32 and that of rounded end 72 plus the action of leaf spring 52 will move rocker member 50 to the other position from where it was located thereby providing snap action operation. Fingers 38 of movable contact members 34 are wipingly moved along stationary contact section 16A because of the downwardly bent orientation of the section of the movable contact members that begins at a location spaced outwardly from embossments 36.

The construction of DIP switch S with membrane 42 in sealed engagement with the top surface of frame 14 or with membranes 42, 44 in sealed engagement with the top and bottom surfaces of frame 14 provides a DIP switch having a sealed electrical contact assembly that will protect the contact assembly from contaminants when the board 26 is subjected to conventional flow soldering and cleaning operations as well as during the normal operating life of the switch. The DIP switch S is also smaller in all dimensions than existing DIP switches thereby enabling it to be used in greater density at a lower profile.

Figure 7:
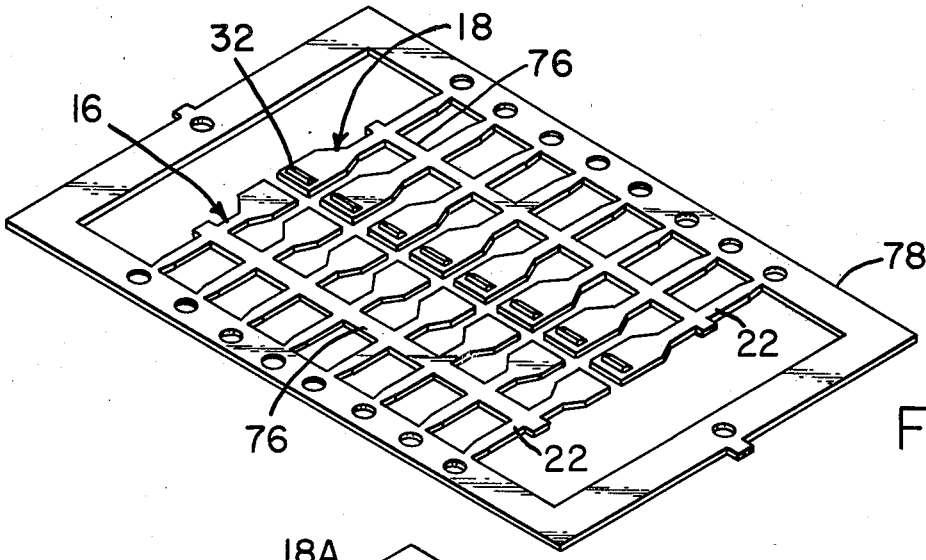
FIGS. 7–17 illustrate the various steps in making the sealed electrical contact assembly which is then latched to a housing having contact-actuating members therein thereby completing the making of a switch.

FIGS. 7–17 illustrate the method of making the sealed electrical contact assembly and the switch. Electrical contact members 16, 18 are stamped and formed from a suitable metal such as, for example, brass or the like in the form of a lead frame as illustrated in FIG. 7 with terminal sections 22 being connected together by sections 76 and their ends connected to the sides of carrier strip 78. Only one carrier strip 78 having the lead frame therein is shown, but the carrier strip is a continuous strip of stamped and formed lead frames with the carrier strip 78 providing a means for carrying the lead frames through gold or other precious metal plating and the manufacturing steps of making the sealed electrical contact assembly and switch made therefrom.

Figure 8:
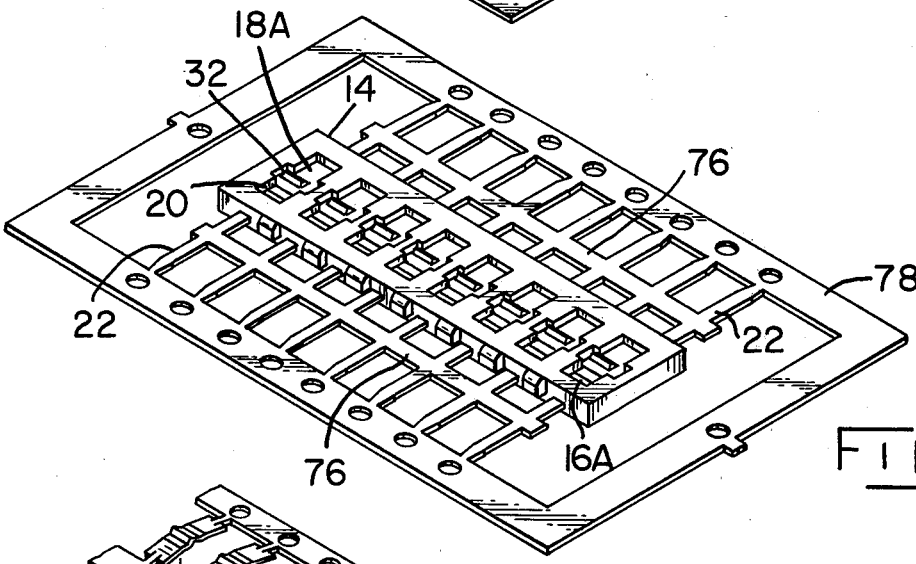
Figure 9:
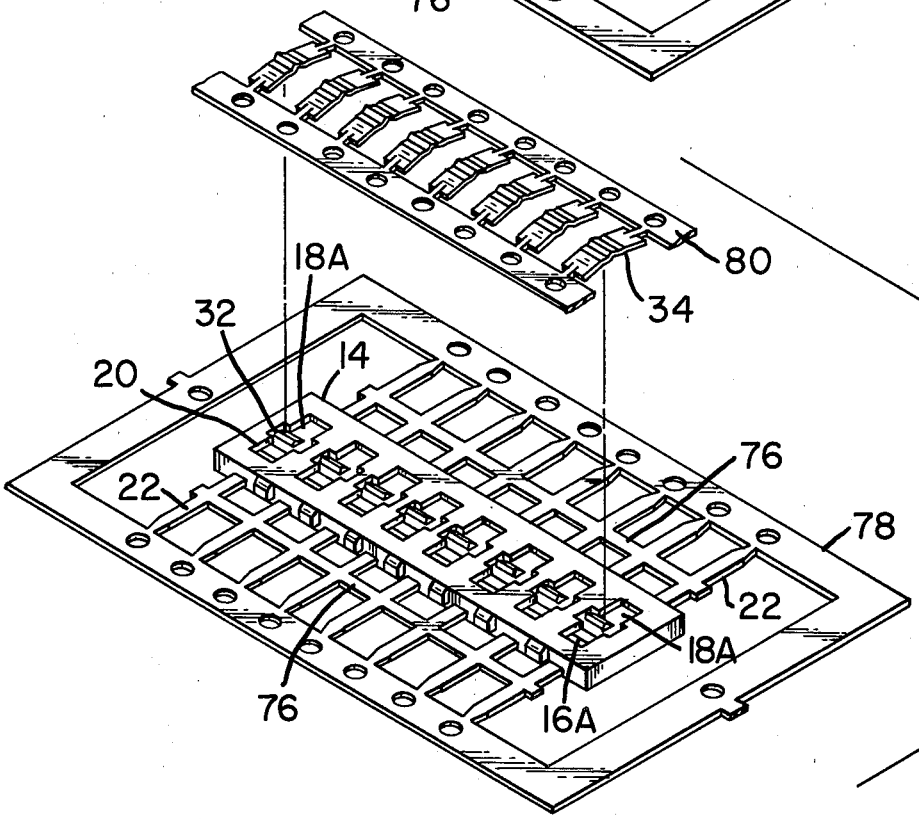
Figure 10:
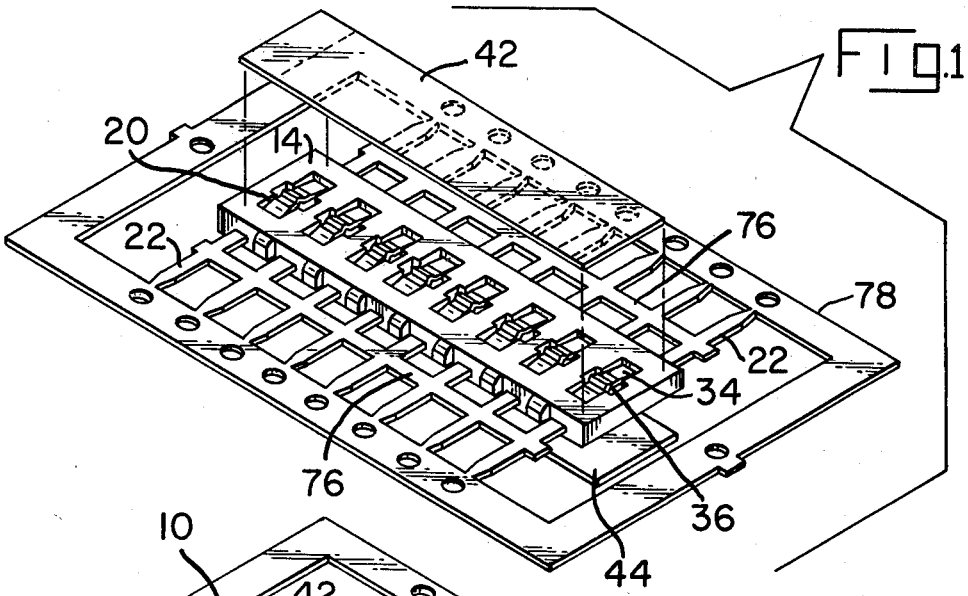

The lead frame is placed in a conventional mold and dielectric frame 14 is molded thereon with recesses 20 formed therein to expose exposed contact sections 16A, 18A of contact members 16, 18 as shown in FIG. 8. Another carrier strip 80 has the ends of gold or other precious metal plated movable contact members 34 connected thereto as shown in FIG. 9 which are sheared from carrier strip 80 and then transferred into recesses 20 of frame 14 as shown in FIG. 10 so that V-shaped embossments 36 are positioned onto pivot members 32 of contact sections 18A. The transferring can be done by transferring members connected to a vacuum. The lead frame 78 and strip 80 of movable contact members 34 can be chemically milled or made in any other conventional manner.

Figure 11:
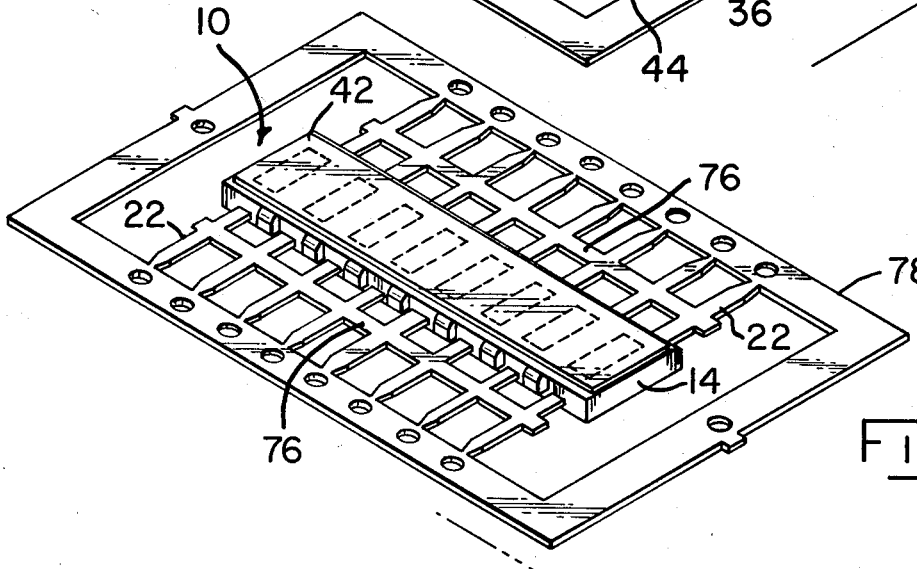

Membranes 42, 44 are then adhesively and sealingly secured onto the top and bottom surfaces of frame 14 as shown in FIG. 11. Membrane 42 maintains movable contact members 34 in position in recesses 20.

Figure 12:
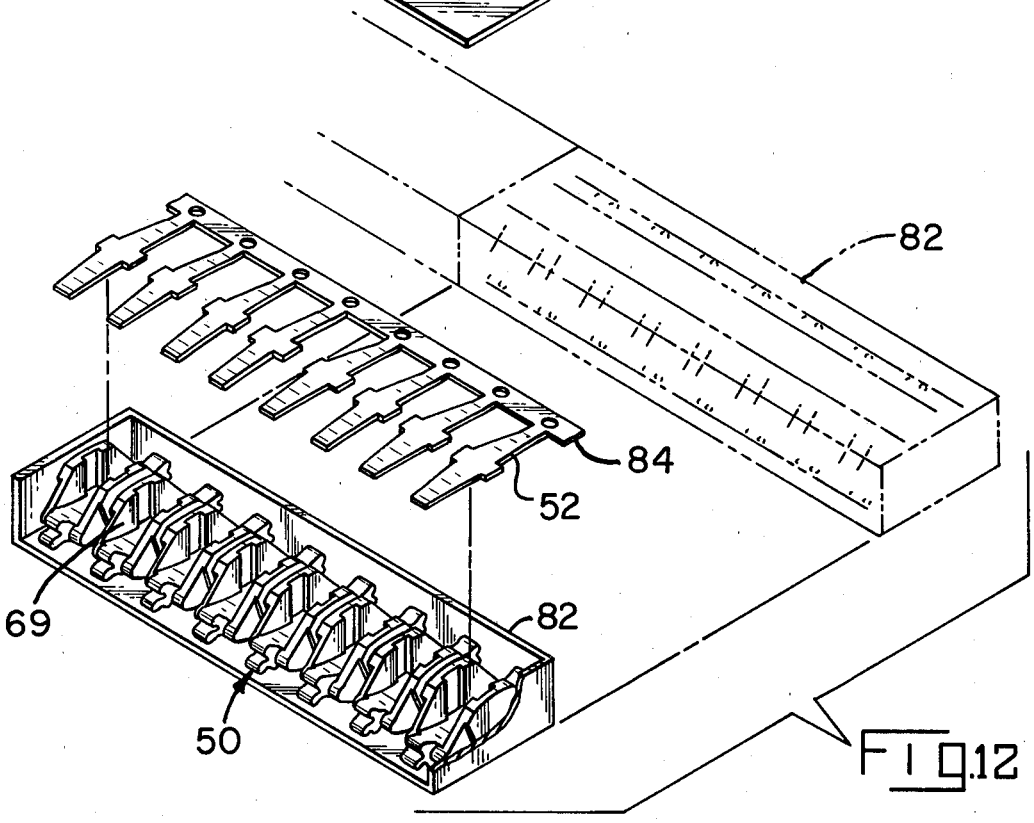
Figure 13:
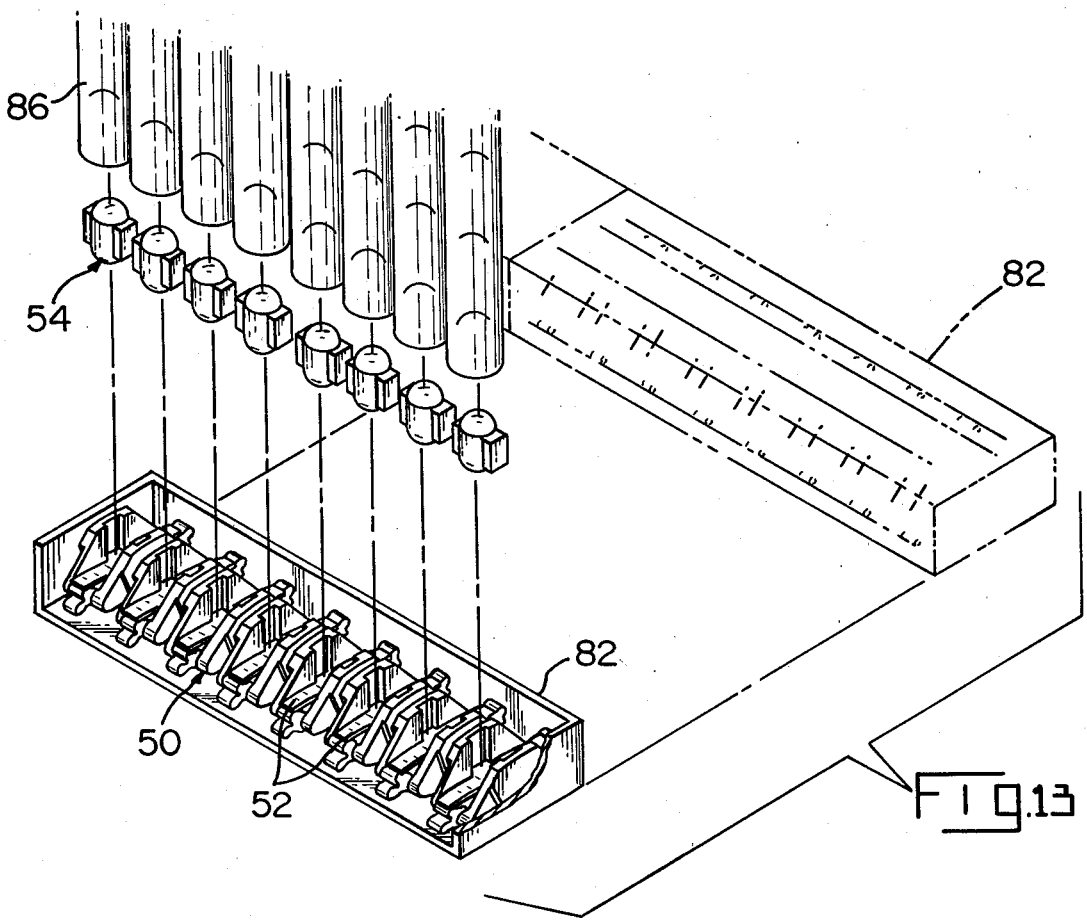

FIGS. 11–13 illustrate loading rocker members 50 with leaf springs 52 and buttons 54. Rocker members 50 are positioned within aligned carrier members 82. The leading carrier member 82 is moved to a station as shown in FIG. 12 so that carrier strip 84 on which leaf springs 52 are located can position leaf springs 52 in slots 69 of rocker members 50. Leaf springs 52 are then severed from carrier strip 84.

Figure 14:
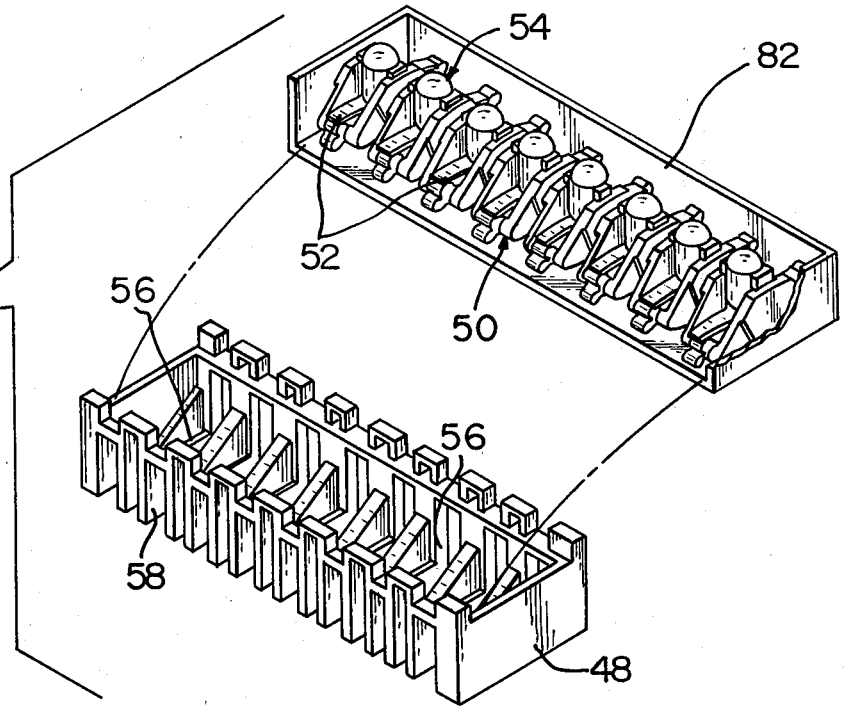

Carrier member 82 is then moved to another station as shown in FIG. 13 so that buttons 54 in tubes 86 are serially inserted therefrom into slots 69 of rocker members 50. Carrier members 82 with fully assembled rocker members 50 is then moved to a further station as shown in FIG. 14 whereat carrier member 82 is tilted to slide assembled rocker members 50 in cavities 56 in housing 48.

An alternative approach would be that in molding the rocker members 50, they can be molded to a carrier member at spaced intervals therealong. Leaf springs are then inserted in slots 69 and severed from carrier strip 84 whereafter buttons 54 are inserted in slots 69. Then the loaded rocker members 50 can be positioned within cavities 56 of housing 48 whereafter they are severed from the carrier member.

Figure 15:
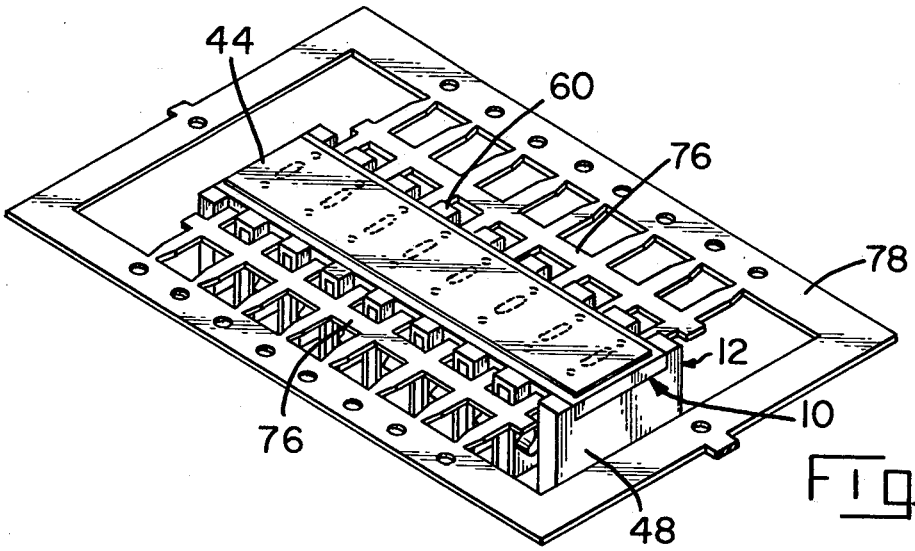
Figure 16:
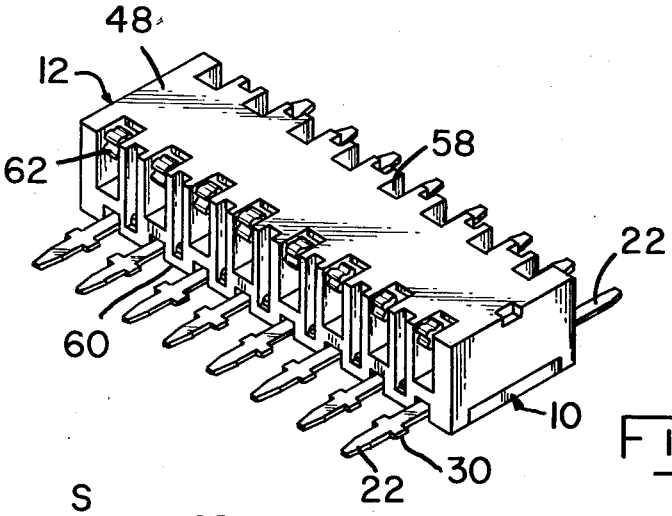
Figure 17:
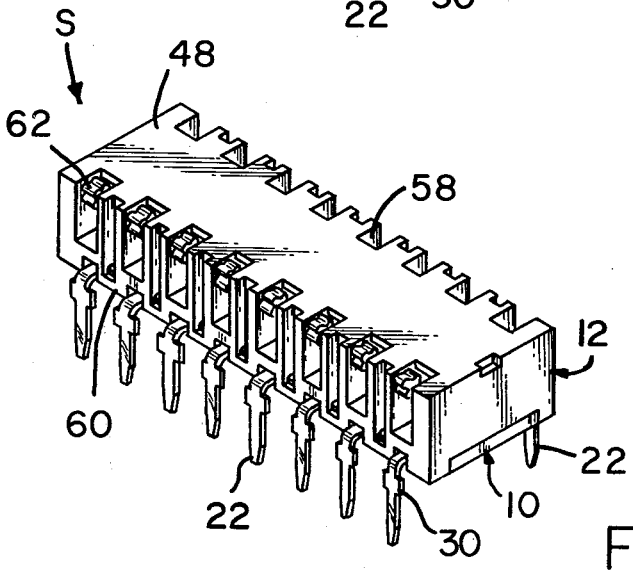

FIG. 11 illustrates the completed sealed electrical contact assembly 10 which is inverted as shown in FIG. 15 and latchably secured onto housing 48 having the rocker members 50 positioned in cavities 56 thereof via latches 60 latchably engaging latching lugs 40 as shown in FIG. 15. Sections 76 are sheared from between terminal sections 22 and the ends of terminal sections 22 are sheared from carrier strip 78 as shown in FIG. 16 and then bent into a proper orientation for mateable engagement with holes 24 of board 26. The completed electrical DIP switch S, as illustrated in FIG. 17, can then be tested and packaged in tubes in the same manner as integrated circuits and they can be loaded into printed circuit boards by automated insertion equipment. Adjacent members 68 can be interconnected when formed or via a suitable adhesive and cavities 56 so profiled to enable gang switching if desired.

The configuration of leaf springs 52 on carrier strip 84 and of buttons 54 enables them to be easily positioned within rocker members 50, and fully-loaded rocker members 50 are easily dropped into the respective cavities 56 of housing 48. This enables actuating mechanism 12 to be readily secured onto sealed contact assembly 10 which itself is readily assembled as illustrated in FIGS. 6–10.

The projections 53 of leaf springs 52 and projections 74 of buttons 54 in recesses 70 of rocker members 50 maintain leaf springs 52 and buttons 54 in position in rocker members 50 and guide the movements of springs 52 and buttons 54 during operation of rocker members 50.

I claim:

1. An electrical switch comprising:

dielectric frame means having recess means in top surface means thereof;

stationary electrical contact means secured in said frame means and including opposed sets of stationary contact section means respectively within said recess means, one of each of the opposed sets of stationary contact section means having pivot means;

movable electrical contact means pivotally mounted onto said pivot means;

housing means secured onto said frame means; and spring-biased contact-operating means movably disposed in said housing means including rocker means having slot means in which leaf spring means and button means are mounted, said leaf spring means urging said button means into engagement with respective movable contact means for moving said movable contact means to one position for electrically connecting said opposed sets of stationary contact section means and to another position for electrically disconnecting said opposed sets of stationary contact section means.

2. An electrical switch as set forth in claim 1 wherein said movable contact means include V-shaped pivot means engaging said pivot means.

3. An electrical switch as set forth in claim 1 wherein free ends of said movable contact means have finger means.

4. An electrical switch as set forth in claim 1 and further comprising:

membrane means sealingly secured onto said frame means over said recess means between said spring-biased contact-operating means and said movable contact means.

5. An electrical switch as set forth in claim 4 and further comprising another membrane means sealingly secured to a bottom surface of said frame means.

6. An electrical switch as set forth in claim 1 wherein said housing means includes opening means, said rocker means include projection means positioned within said opening means, notch means in said projection means for engagement by a probe to move said rocker means from said one position to said another position.

7. An electrical switch as set forth in claim 6 wherein said rocker means includes pie-shaped member means extending outwardly from each side thereof for pivotally mounting said rocker means between an inside surface of said housing means and a top surface of said frame means.

8. An electrical switch as set forth in claim 7 wherein said rocker means include shoulder means for engagement with said inside surface to limit movement of said rocker means in said one position and said another position.

9. An actuating mechanism comprising:

housing means having a top, bottom and sides, said housing means having opening means therein;

actuating means having slot means mounted in said housing means;

pivot means on said actuating means and said housing means pivotally mounting said actuating means for reciprocal movement;

pivot member means on said bottom;

movable member means having embossment means with said embossment means engaging said pivot member means enabling said movable member means to pivot thereabout;

said actuating means including leaf spring means and button means, said leaf spring means and said button means disposed in said slot means with said leaf spring means disposed between bottom surface means of said slot means and said button means so that said leaf spring means biases said button means in engagement with said movable member means on one side of said embossment means to maintain said movable member means in one position, to maintain said movable member means in another position when said actuating means moves said spring-biased means to the other side of said embossment means in engagement therewith and to maintain said pivot means of said actuating means and housing means in engagement; and operating means of said actuating means extending through said opening means of said housing means for operating said actuating means about said pivot means to move said spring-biased button means along said movable member means from the one side of said embossment means to the other side thereof.

10. An actuating mechanism as set forth in claim 9 wherein said actuating means comprises stop means engageable with said housing means to limit movement of said actuating means.

11. An actuating mechanism as set forth in claim 10 wherein said stop means comprise inclined surfaces meeting at an apex, said pivot means comprising pie-shaped means having apexes coincident with said apex, said apexes engaging an inside surface of said top.

12. An actuating mechanism as set forth in claim 9 wherein said bottom of said housing means includes recess means having exposed stationary electrical contact means, one of said electrical contact means including said pivot member means on which said embosment means of said movable member means defining movable electrical contact means is pivotally mounted.

13. An electrical switch of the type comprising stationary contact members having spaced stationary contact sections secured in a dielectric frame member, movable contact members pivotally mounted onto one of the stationary contact sections, and a housing member secured onto the dielectric frame including actuating members pivotally mounted therein to move the movable contact members from one position to another, characterized in that said actuating members have slots therein, leaf spring members disposed in said slots, button members movably mounted in said slots with said leaf spring members biasing said button members into engagement respectively with said movable contact members, and actuating sections in said actuating members to move said actuating members from the one position to the other.

14. An electrical switch as set forth in claim 13 characterized in that said actuating sections extend outwardly from openings in said housing member and include V-shaped recesses to operate said actuating members from above or at the sides of said switch.

15. An electrical switch as set forth in claim 14 characterized in that said slots have recesses therein so that projections of said leaf spring members and said button members are disposed therein to guide movement thereof along said slots.

16. An electrical switch as set forth in claim 15 characterized in that said button members have rounded ends.

17. An electrical switch as set forth in claim 13 characterized in that said actuating members have pie-shaped projections with apexes thereof engaging an inside top surface of said housing member on arcuate surfaces for rockable movement along said dielectric frame member.

18. An electrical switch as set forth in claim 17 characterized in that said actuating members include stop surfaces engageable with said inside top surface to limit movement of said actuating members.

19. An electrical switch as set forth in claim 18 characterized in that said stop surfaces meet at an apex coincident with the apexes of said pie-shaped projections.

20. An electrical switch as set forth in claim 13 characterized in that a membrane is sealingly secured onto said dielectric frame member covering said stationary contact sections and the respective movable contact members therefor.

* * * * *